United States Patent [19]

Smith

[11] 4,057,010

[45] Nov. 8, 1977

[54] VEHICLE MOUNTED COMPACTOR APPARATUS

[75] Inventor: Gary D. Smith, Waco, Tex.

[73] Assignee: Mobile Auto Crushers Corporation of America, Dallas, Tex.

[21] Appl. No.: 660,525

[22] Filed: Feb. 23, 1976

Related U.S. Application Data

[63] Continuation of Ser. No. 479,721, June 17, 1974, abandoned.

[51] Int. Cl.[2] ..... B30B 15/16

[52] U.S. Cl. ..... 100/50; 100/73; 100/96; 100/98 R; 100/100; 100/218; 100/249; 100/256; 100/269 R; 91/412; 214/83.3

[58] Field of Search ..... 100/50, 73, 74, 75, 100/93 R, 98 R, 100, 218, 269 R, 96, 97, 256, 249; 91/411 A, 412; 214/83.3

[56] References Cited

U.S. PATENT DOCUMENTS

| | | | |
|---|---|---|---|
| 446,799 | 2/1891 | Thorpe | 91/412 |
| 1,110,283 | 9/1914 | Beaston | 100/249 X |
| 2,224,956 | 12/1940 | Ernst et al. | 91/411 A |
| 2,780,987 | 2/1957 | Wall | 100/249 X |
| 3,195,447 | 7/1965 | Taylor | 100/100 X |
| 3,330,088 | 7/1967 | Dunlea | 100/73 X |
| 3,355,044 | 11/1967 | Nelson | 100/100 X |
| 3,467,001 | 9/1969 | Balbi | 100/100 X |
| 3,583,164 | 6/1971 | Sherrill | 100/100 X |
| 3,613,556 | 10/1971 | Wright | 100/98 R |

FOREIGN PATENT DOCUMENTS

| | | | |
|---|---|---|---|
| 946,924 | 1/1964 | United Kingdom | 100/50 |

*Primary Examiner*—Billy J. Wilhite

*Attorney, Agent, or Firm*—Howard E. Moore; Gerald G. Crutsinger; Larry B. Dwight

[57] ABSTRACT

Vehicle mounted compactor apparatus comprising multiple pressure actuated cylinders connected such that fluid is initially directed to a first cylinder to provide rapid reciprocating movement of a ram through a chamber to form a low density bale and is subsequently directed to second and third cylinders to provide low speed movement at increased compactive force to increase the density of the bale. A bonding agent is sprayed into the chamber to eliminate necessity for tying the bale. An elevator deposits the bale in a storage container pivoted to the frame of the vehicle for dumping.

14 Claims, 14 Drawing Figures

VEHICLE MOUNTED COMPACTOR APPARATUS

This is a continuation, of application Ser. No. 479,721, filed June 17, 1974 now abandoned.

BACKGROUND

Bale forming apparatus heretofore devised and particularly compaction apparatus mounted on vehicles for use in refuge collecting have generally provided a material compression ratio of approximately four or five to one.

Typical vehicle mounted compaction apparatus is illustrated in U.S. Pat. No. 3,231,111 and U.S. Pat. No. 3,687,313 wherein a ram is employed for compacting refuge into a storage compartment for subsequent dumping.

Certain other compaction devices for example of the type disclosed in U.S. Pat. No. 3,355,044 have compressed refuge into relatively low density bales which were individually conveyed into a storage compartment on the vehicle. In an effort to maintain bales in a compacted condition, certain other apparatus for example of the type disclosed in U.S. Pat. No. 3,557,683 was developed wherein the compacted material was urged into cartons or tied with wire as disclosed in U.S. Pat. No. 3,583,164 to maintain the bales in a relatively dense integral condition.

Apparatus heretofore devised for forming dense integral bales has been unnecessarily complicated and expensive to manufacture, operate and maintain.

SUMMARY OF INVENTION

I have devised improved bale forming apparatus comprising a compaction chamber having an inlet or a feed passage and an outlet passage through which a ram is moveable by a plurality of hydraulic cylinders. Pressurized fluid is directed to the first cylinder to move the ram rapidly through the compartment for compressing material to form a bale. When the compacted material exerts a predetermined pressure upon the ram, pressurized fluid is directed to additional pressure actuated cylinders to substantially increase force applied by the ram to the material being compacted, which under most operating conditions will form a bale of sufficient density to maintain its integrity without being tied with wires and the like.

To facilitate forming a dense bale which does not require tying, a suitable bonding agent such as water and resin is sprayed into the chamber bonding the material together as a result of substantial force, for example, 1500 pounds per square inch, applied by the ram and the accompanying increase in temperature for example from 70° F ambient temperature to 200° F during the compression process.

A gate is positioned across the outlet passage from the chamber. However, to facilitate movement of the gate away from the chamber the face of the gate is not perpendicular to the axis of the chamber. Consequently, a slight initial movement of the gate transversally of the chamber causes the gate to be moved longitudinally of the chamber and away from the end of the bale thereby reducing friction force which would otherwise restrain the gate against movement.

A primary object of the invention is to provide bale forming apparatus having an improved pressure actuated compression cylinder arrangement providing high speed reciprocating movement of a ram during initial stages of the compaction process and subsequently exerting higher force at low speed while employing pumps having lower flow capacity and horsepower than pumps heretofore required to form bales of comparable density.

A further object of the invention is to provide bale forming apparatus capable of forming bales of paper and similar materials of sufficiently high density to permit ejection from a compression chamber without tying.

A further object of the invention is to provide bale forming apparatus adapted to permit spraying of a fine mist of adhesive material into a compaction chamber to bond compressed material into an integral bale.

A further object of the invention is to provide bale forming apparatus particularly adapted for installation on a vehicle frame employed in collection of refuge to form bales having a density greater than that of soil.

Other and further objects of the invention will become apparent upon referring to the detailed description hereinafter following and to the drawings annexed hereto.

DESCRIPTION OF DRAWING

Drawings of two preferred embodiments of the invention are annexed hereto so that the invention may be better and more fully understood, in which.

Numeral references are employed to designate like parts throughout the various figures of the drawing.

PREFERRED EMBODIMENT

Figure 1:
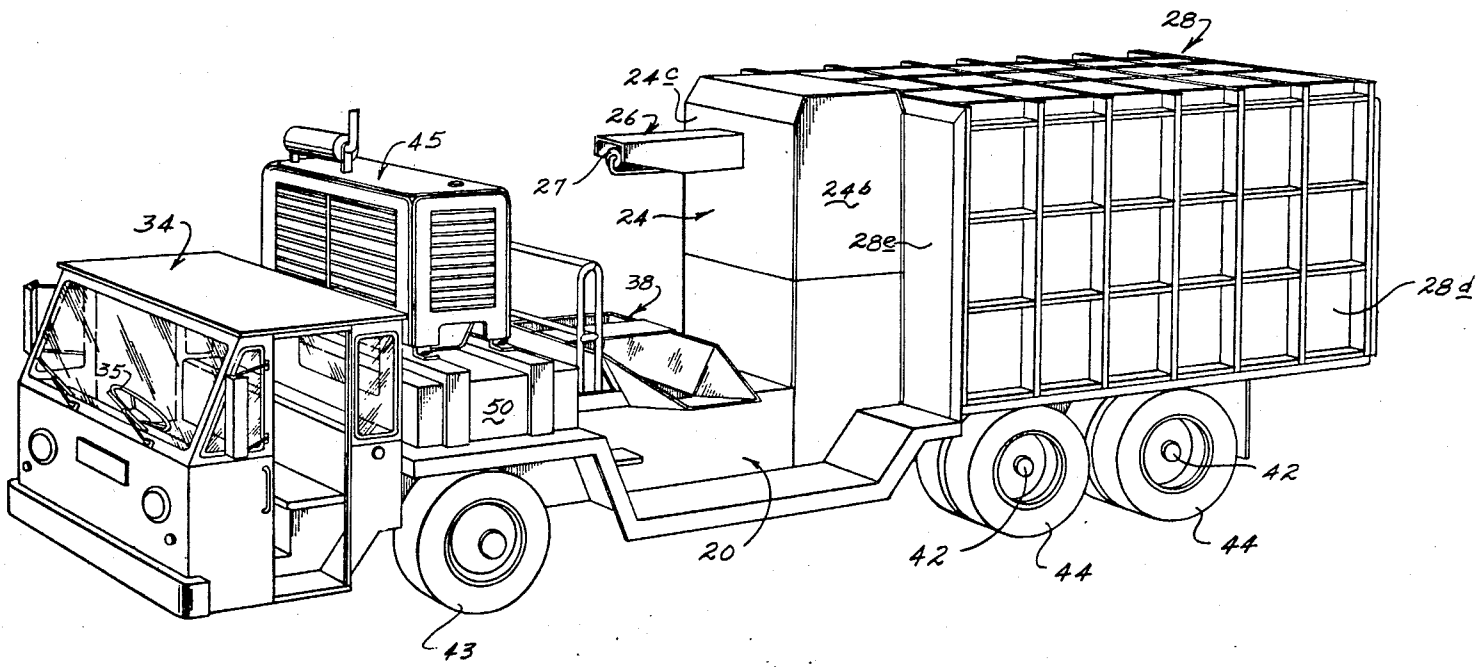
FIG. 1 is a perspective view of the bale forming apparatus mounted on a vehicle.
Figure 2:
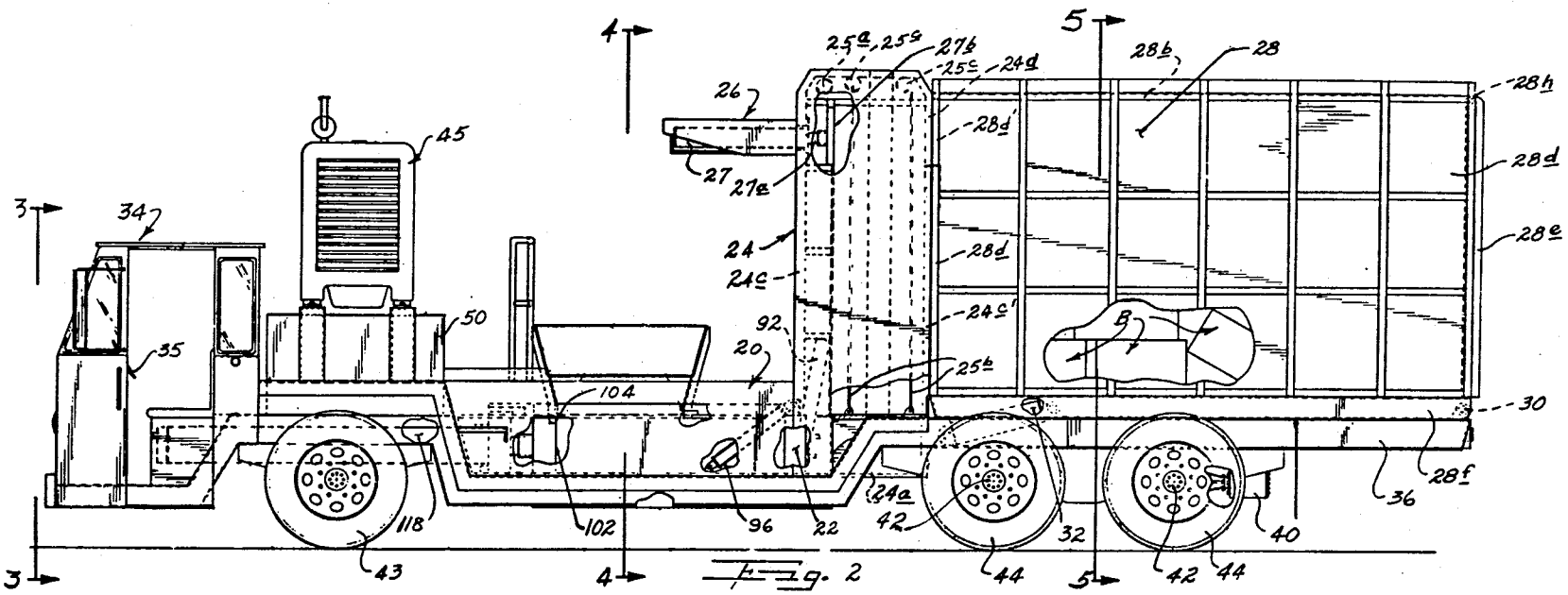
FIG. 2 is a side elevational view of the vehicle illustrated in FIG. 1.

Referring to FIGS. 1 and 2 of the drawing the numeral 20 generally designates bale forming apparatus having a gate 22 disposed across the end thereof which is moveable upwardly to permit movement of a bale B onto elevating apparatus 24 such that the bale can be lifted and discharged by an ejection mechanism 26 into storage container 28. Storage container 28 is preferably pivotally connected by a suitable hinge 30 adjacent the rear end of the vehicle and is tiltable by a pressure actuated cylinder 32 for dumping bales B from storage container 28.

The vehicle preferably comprises a walk-through type cab 34 having doors at opposite sides thereof to permit entry by workmen from either side. Steering wheel 35 is preferably located in the center of the cab such that the driver is seated to permit entry and departure of workmen from either side of the cab. The front wheels 43 of the vehicle are steerable.

The central portion of the vehicle chassis 36 preferably has a low profile such that workmen standing on the ground can deposit bags of garbage or empty trash cans into hopper 38 from either side of the vehicle.

The rear end of the chassis 36 preferably has a hydraulic drive motor 40 connected for powering dual rear axles to propel the vehicle.

Trailer 36 comprises longitudinal extending frame members 37 welded or otherwise rigidly secured to transversely extending frame members 38. Drive motor 40 is drivingly secured to rear axle 42 having wheels 44 mounted thereon.

As will be hereinafter more fully explained a power unit 45 has an output shaft for driving one or more pumps for deliverying pressurized fluid from reservoir 50 to pressure actuated cylinders in bale forming apparatus 20, elevating apparatus 24 and to ejection mechanism 26, as well, as to tilt cylinder 32, and to drive motor 40.

In the particular embodiment of the invention illustrated in FIG. 1 of the drawing, power unit 45 comprises an internal combustion engine. However, it should be appreciated that other power units may be employed, such as an electrically driven motor, particularly if bale forming apparatus 20 is not mounted on a vehicle frame.

Figure 6:
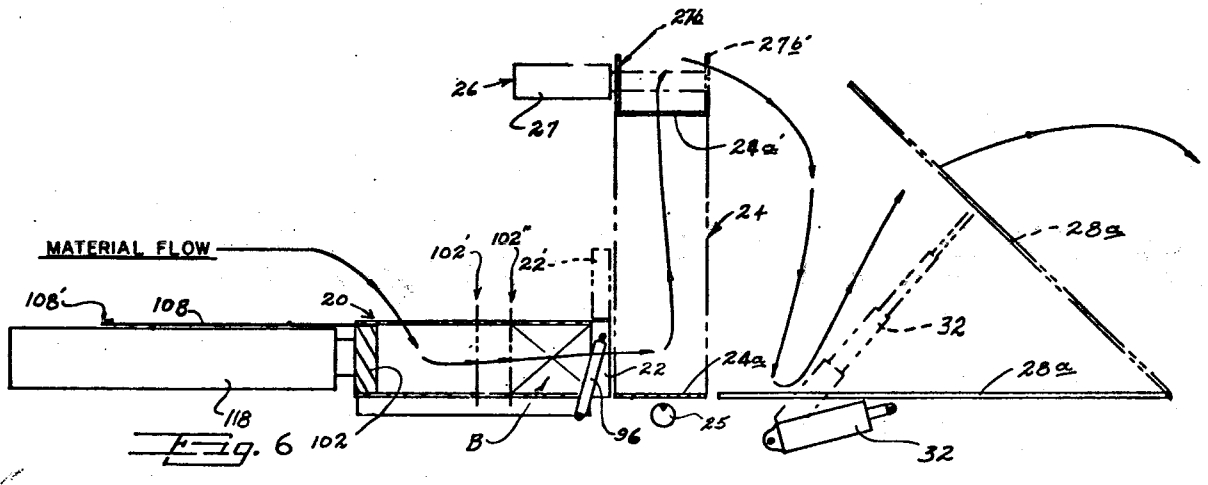
FIG. 6 is a diagrammatic view illustrating the sequence of operation.
Figure 5:
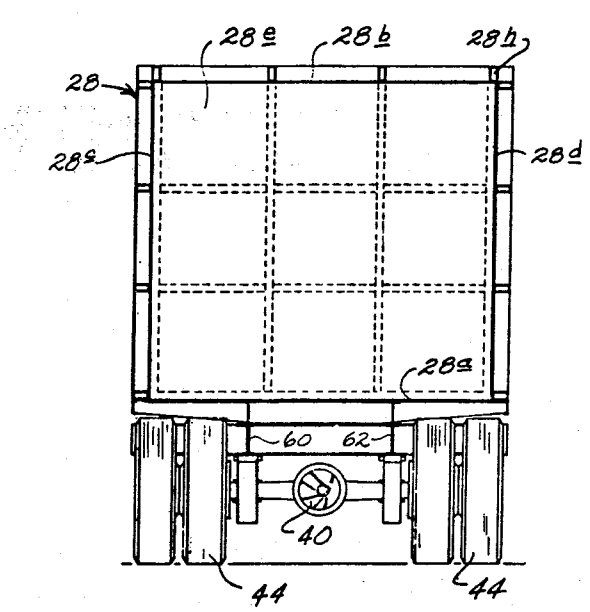
FIG. 5 is a cross-sectional view taken along line 5—5 of FIG. 2.
Figure 4:
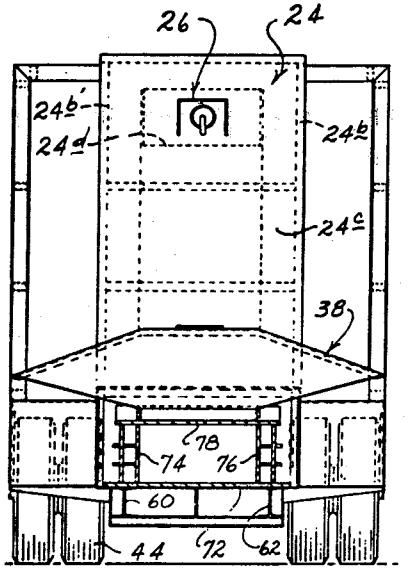
FIG. 4 is a cross-sectional view taken along the line 4—4 of FIG. 2.
Figure 3:
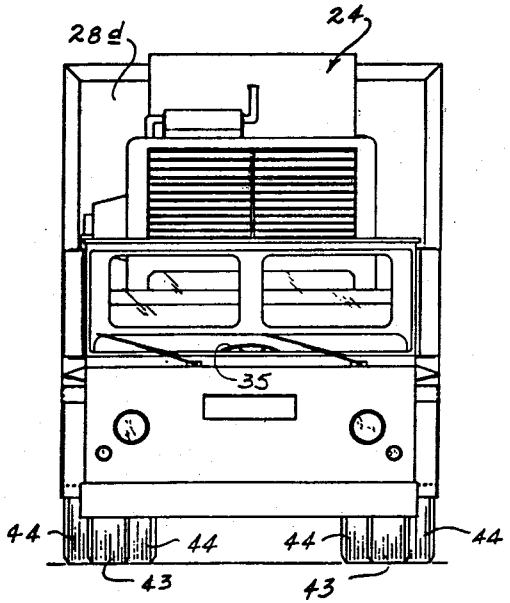
FIG. 3 is a front elevational view of the vehicle.

Referring to FIGS. 2, 4, and 6 of the drawing, elevating apparatus 24 comprises a platform **24*a* slideably disposed through a housing, which in the particular embodiment of the invention illustrated in the drawing comprises spaced side walls 24*b* and 24*b*' secured between opposite ends of front wall 24*c* and back wall 24*c*'**. The housing of the elevating apparatus has suitable horizontal and vertically extending reinforcing members to provide structural rigidity.

Platform **24*a* is moveable vertically through the housing by suitable means such as fluid actuated lift motor 25 having a drive shaft drivingly connected to winch drum 25*a* for extending and retracting cables 25*b* having ends secured to platform 24*a* and extending about pulleys 25*c* mounted in the upper end of the housing of the elevating apparatus 24**.

The back wall **24*c*' of the housing of elevating apparatus 24 has a passage 24*d* formed therein while the front wall 24*c* has a pressure actuated ejection cylinder 27 secured thereto for movement of bales B from platform 24*a* through passage 24*d***, as will be hereinafter more fully explained.

Ejection cylinder 27 has a piston moveable longitudinally therethrough connected to a piston rod **27*a* which is secured to rectangular pressure plate 27*b***.

Storage container 28 comprises a floor **28*a*, roof 28*b*, side walls 28*c* and 28*c*', and front and rear walls 28*d* and *e* secured together to form an enclosure. The enclosure rests upon rails 28*f* pivotally secured at the rear end thereof by hinge 30 to the vehicle chassis 36. Rails 28*f* are pivotal upwardly by dump cylinders 32 having a piston and rod slideably disposed therethrough and having one end pivotally secured to the chassis 36 and having the rod pivotally secured to rails 28*f***.

The front wall **28*d* of storage container 28 has a passage extending therethrough substantially coinciding with passage 24*d* formed in back wall 24*c*'** of the housing of elevating apparatus.

The rear wall **28*e* of storage container 28 is preferably suspended from the upper end by hinges 28*h* to permit dumping of bales B from the rear of the vehicle as rails 28*f* are elevated while causing the rear wall 28*e* to move into sealing engagement with the rear end of storage container 28 as rails 28*f* are moved downwardly to the position illustrated in FIG. 2**.

Referring to FIGS. 2 and 6 of the drawing, bales are ejected from bale forming apparatus 20 onto platform **24*a* of elevating apparatus 24. Motor 25 is energized moving platform 24*a* to position indicated at 24*a*'. Pressure plate 27*b* is moved to position 27*b*' as the piston rod 27*a* of pressure actuated ejection cylinder 27 is extended. A bale B is ejected from platform 24*a* through passage 24*d* and passage 28*d*' onto the floor 28*a* of storage container 28. Dump cylinder 32 is employed for tilting floor 28*a*** to the position illustrated in dashed outline for dumping bales B from the vehicle.

Figure 7:
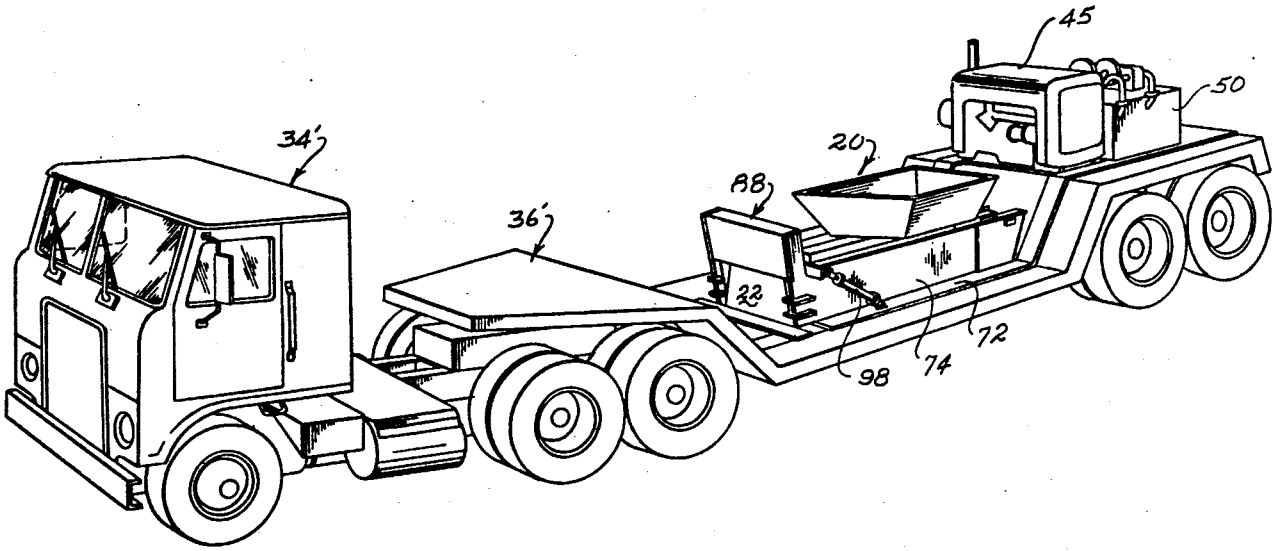
FIG. 7 is a perspective view of the bale forming apparatus mounted on a modified form of a vehicle.
Figure 8:
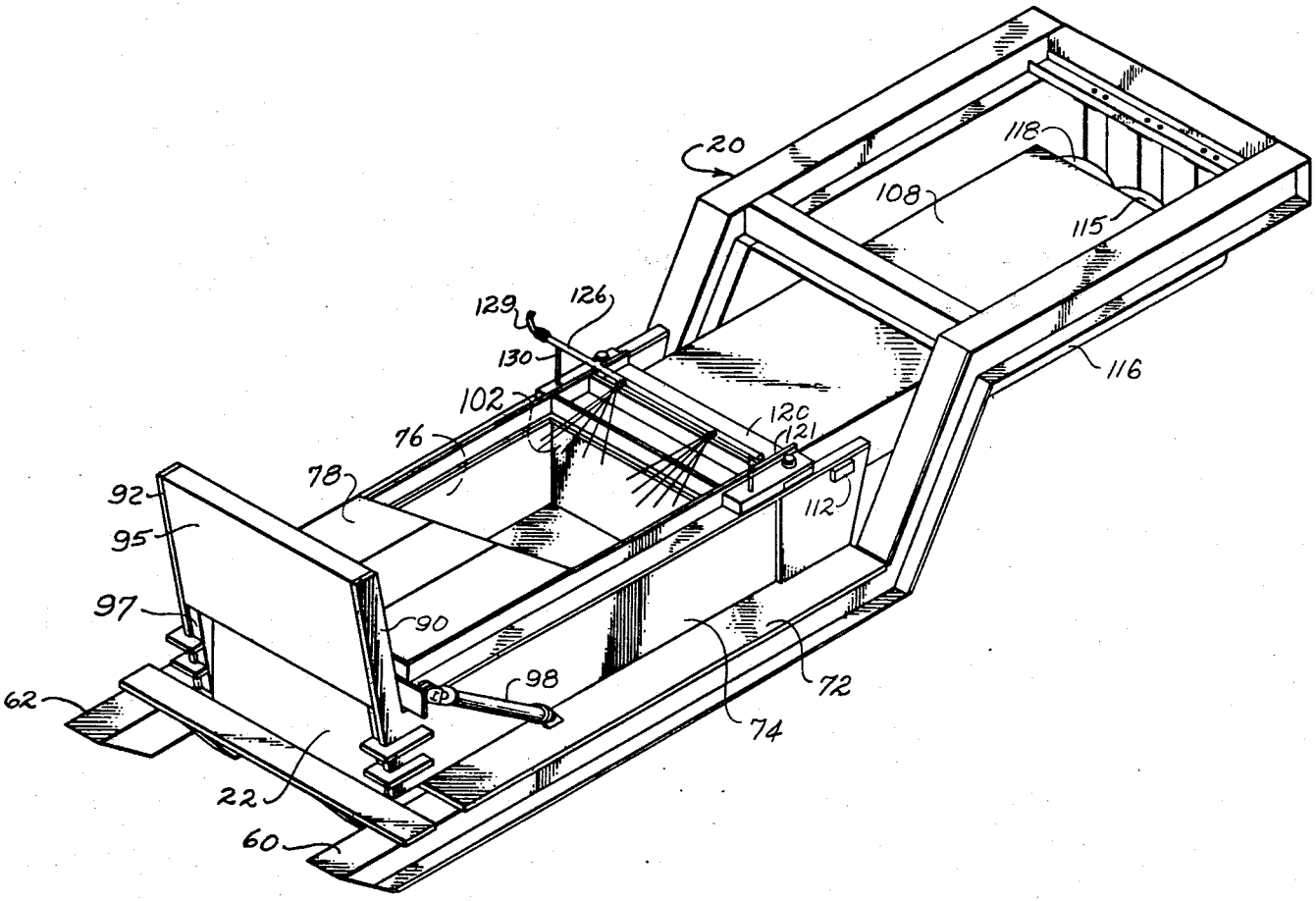
FIG. 8 is a perspective view of the bale forming apparatus.

A modified form of vehicle for transporting bale forming apparatus 20 is illustrated in FIG. 7 of the drawing.

The vehicle illustrated in FIG. 7 comprises a tractor 34' having a trailer 36' secured thereto. In the embodiment of the vehicle illustrated in FIG. 7 of the drawing no storage or dumping mechanism is employed. Power unit 45 delivers pressurized fluid from reservoir 50 to the bale forming apparatus for forming bales. After a bale has been formed it is ejected from bale forming apparatus and manually removed from trailer 36' or stored thereon for subsequent unloading.

BALE FORMING APPARATUS

Details of construction of bale forming apparatus 20 are illustrated in FIGS. 8–11 of the drawing.

Bale forming apparatus 20 comprises suitable supporting structure such as spaced skids 60, 62 and 64 connected by transversely extending brace members 66, 68 and 70 welded or otherwise secured together to form a strong, rigid structure upon which a compaction chamber and compactor apparatus are mounted.

The compaction chamber comprises a base plate 72 having upwardly extending side walls 74 and 76, the lower ends of which are welded or otherwise rigidly secured to base plate 72, and cover plate 78 welded or otherwise rigidly secured to upper edges of side walls 74 and 76. Lateral braces 80 and 82 extend longitudinally of side walls 74 and 76 and carry tension loading as well as resisting outwardly directed forces on side walls 74 and 76.

Figure 9:
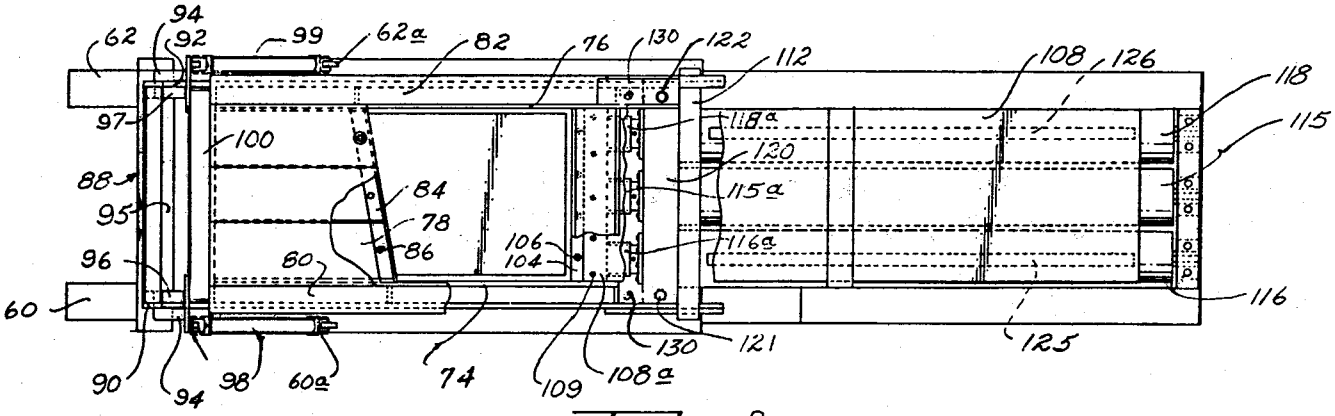
FIG. 9 is a plan view of the bale forming apparatus.
Figure 11:
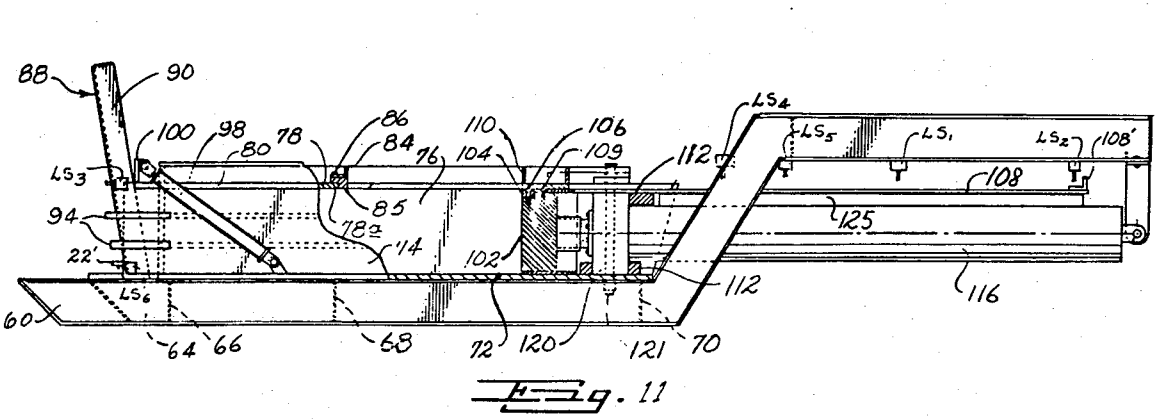
FIG. 11 is a side elevational view of the bale forming apparatus.
Figure 10:
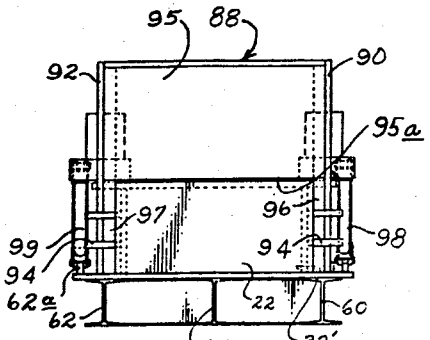
FIG. 10 is an end view of the bale forming apparatus.

As best illustrated in FIGS. 9 and 11, a blade holder 84 has opposite ends welded or otherwise secured to side walls 74 and 76 and has apertures formed therein to receive screws 86 which extend through openings in cutter blade 85 and into threaded openings formed in cover plate 78. Cutter blade 85 comprises a rectangular bar having a groove formed therein into which the leading edge **78*a* of cover plate 78 extends. Cutter blade 85, as best illustrated in FIG. 9**, is angularly disposed relative to the compaction chamber to facilitate shearing objects extending through the inlet passage into the compaction chamber as the ram moves therethrough as will be hereinafter more fully explained.

Gate 22 is slideably secured to a gate guide frame 88 adapted to form an inclined track adjacent the discharge end of the compaction chamber.

Gate guide frame 88 comprises stanchions 90 and 92 secured to ends of side walls 74 and 76 by straps 94 welded thereto. A gate guide plate 95 is secured across upper ends of stanchions 90 and 92 and has a lower edge 95*a* positioned vertically slightly above the lower edge of cover plate 78 forming a discharge passage therebelow through which bales are ejectable.

Gate 22 comprises a rigid plate suitably reinforced to provide structural strength and having triangular shaped rails 96 and 97 secured to opposite sides thereof and engageable with straps 94 secured to stanchions 90 and 92 and being moveable along gate guide plate 95.

Gate lift cylinders 98 and 99 have lower ends pivotally secured to lugs 60*a* and 62*a* secured to skids 60 and 62, respectively, and have upper ends pivotally secured to beam 100 extending across the upper end of gate 22.

A plunger head 102 is slideably disposed through the hollow portion of the compaction chamber of bale forming apparatus 20 and has a shear bar 104 secured in a groove formed in an upper corner thereof by set screws 106. The leading edge 108*a* of a shield plate 108 is secured to the upper edge of plunger head 102 by set screws 109.

A guide, which in the particular embodiment of the invention illustrated in the drawing comprises a channel member 110, having opposite ends welded or otherwise secured to side walls 74 and 76, is positioned in sliding engagement with the upper surface of shear bar 104 and shield plate 108. The guide 110 moves debris deposited upon shield plate 108, while plunger head 102 is moved into the compaction chamber, into the compaction chamber as plunger head 102 and shield 108 are retracted to the position illustrated in FIG. 11.

A primary cylinder 115 and a pair of secondary cylinders 116 and 118 are secured to a common cylinder head 120 which extends transversely across the end of the compaction chamber and which is secured by anchor pins 121 and 122 to skid members 60 and 62, respectively. Each of the cylinders 15, 16 and 18 has a piston slideably disposed therein to which is connected a piston rod having an outer end secured in sleeves 115*a*, 116*a*, and 118*a*, respectively, secured to plunger head 102.

Tie bars 112 extend between side walls 74 and 76 adjacent upper and lower ends of cylinder head 120 and function in conjunction with anchor pins 121 and 122 to restrain the cylinder head 120 against movement relative to the compaction chamber. Rails 125 and 126 are secured to secondary cylinders 116 and 118 for supporting shield plate 108.

When bale forming apparatus 20 is employed for forming bales of fibrous material such as paper, wood fibers and the like, it is desirable to spray a bonding agent into the compaction chamber for binding fibers together and to provide a water-proof protective layer over the outer surface of the bale to provide protection from the elements when stored for an extended period of time without protection from wind and rain.

As will be hereinafter more fully explained spray bar 126 having spray nozzles 128 communicating with the inside thereof is secured to support posts 130 adjacent the compaction compartment of bale forming apparatus 20. Liquid is delivered to spray bar 126 through a conduit 129.

Under certain operating conditions it is desirable to provide apparatus for automatically feeding, shredding and depositing material into the compaction chamber of bale forming apparatus 20.

Figure 12:
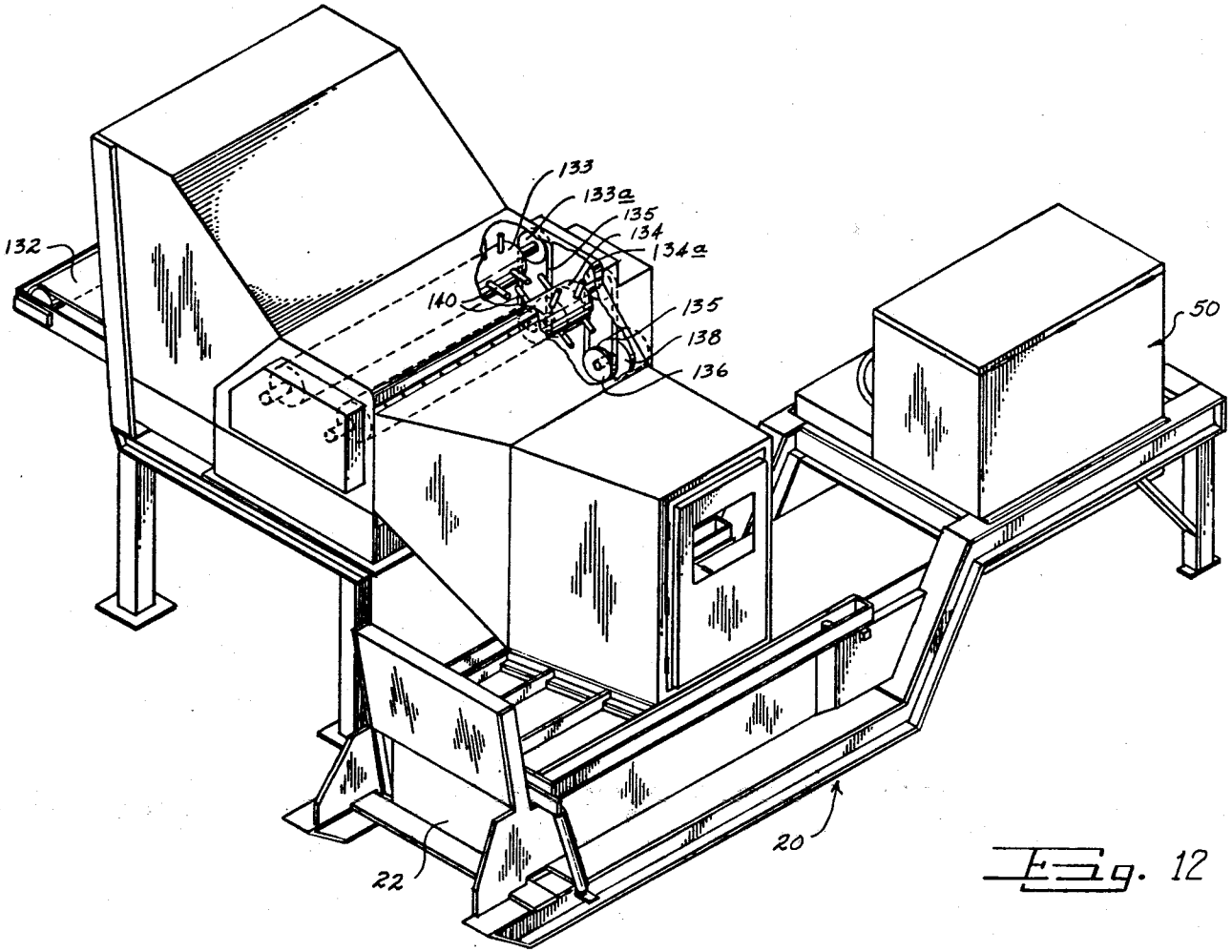
FIG. 12 is a perspective view of the bale forming apparatus having a shredder associated therewith.

The apparatus illustrated in FIG. 12 of the drawing, comprises a conveyor belt 132 extending about rollers (not shown) at least one of which is powered by some suitable means such as a hydraulically driven motor for rotating conveyor belt 132.

Material deposited upon conveyor belt 132 is carried through suitable shredding apparatus, for example, adjacent rollers 133 and 134 having sprockets 133*a* and 134*a* mounted on ends thereof and driven by a chain 135 by a sprocket 136 which is in turn driven by hydraulic motor 138. Rollers 134 and 138 preferably have radially extending tynes 140 mounted thereon and sprocket 133*a* is preferably of larger diameter than sprocket 134*a* such that tynes 140 on roller 134 move at a speed exceeding that of tynes 140 on roller 133. The tynes on the rollers moving at different speeds engage material carried adjacent thereto thereby fragmenting the material which is deposited into the compaction chamber of bale forming apparatus 20.

Figure 13:
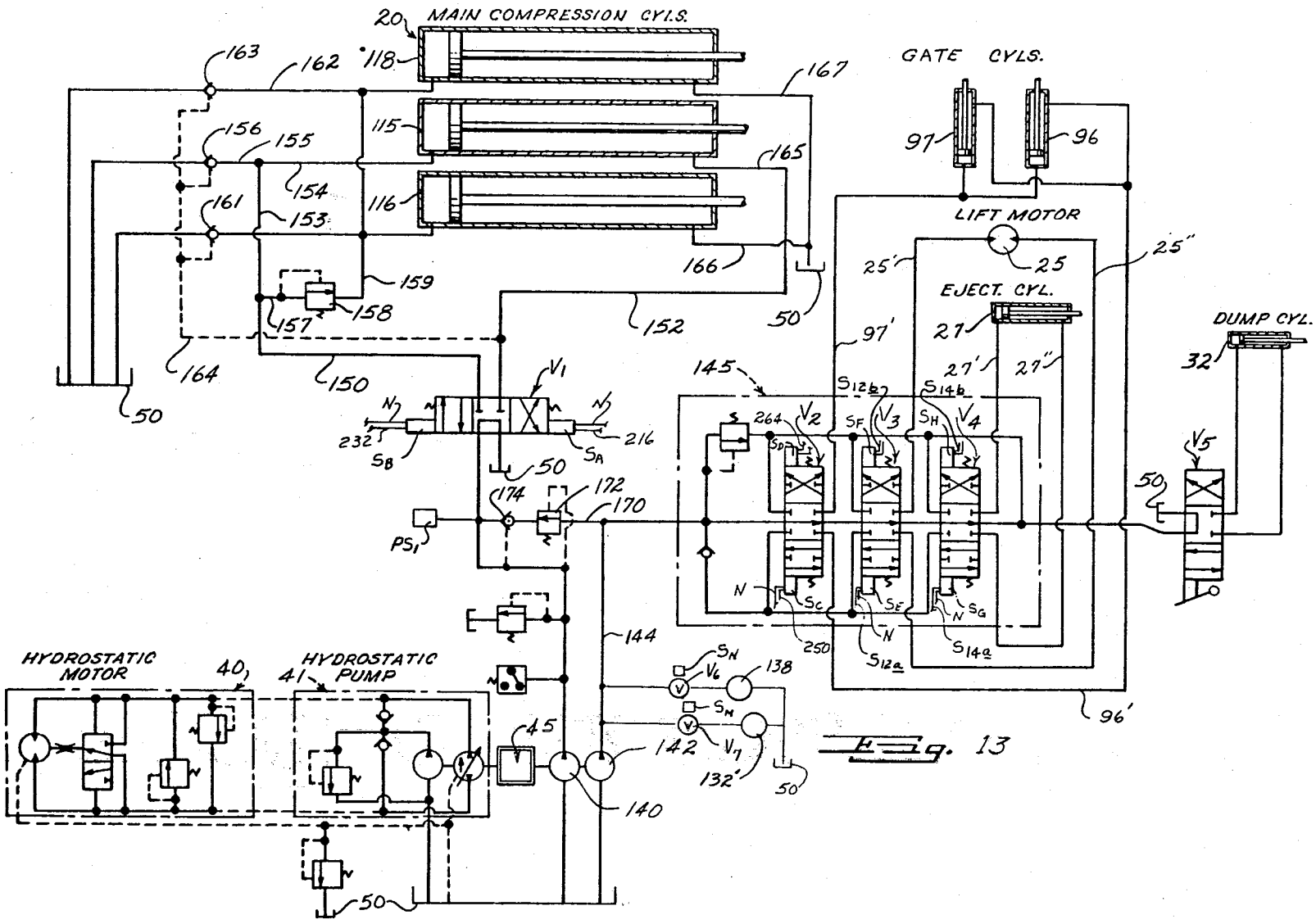
FIG. 13 is a diagram of the hydraulic circuit employed in the bale forming apparatus.
Figure 14:
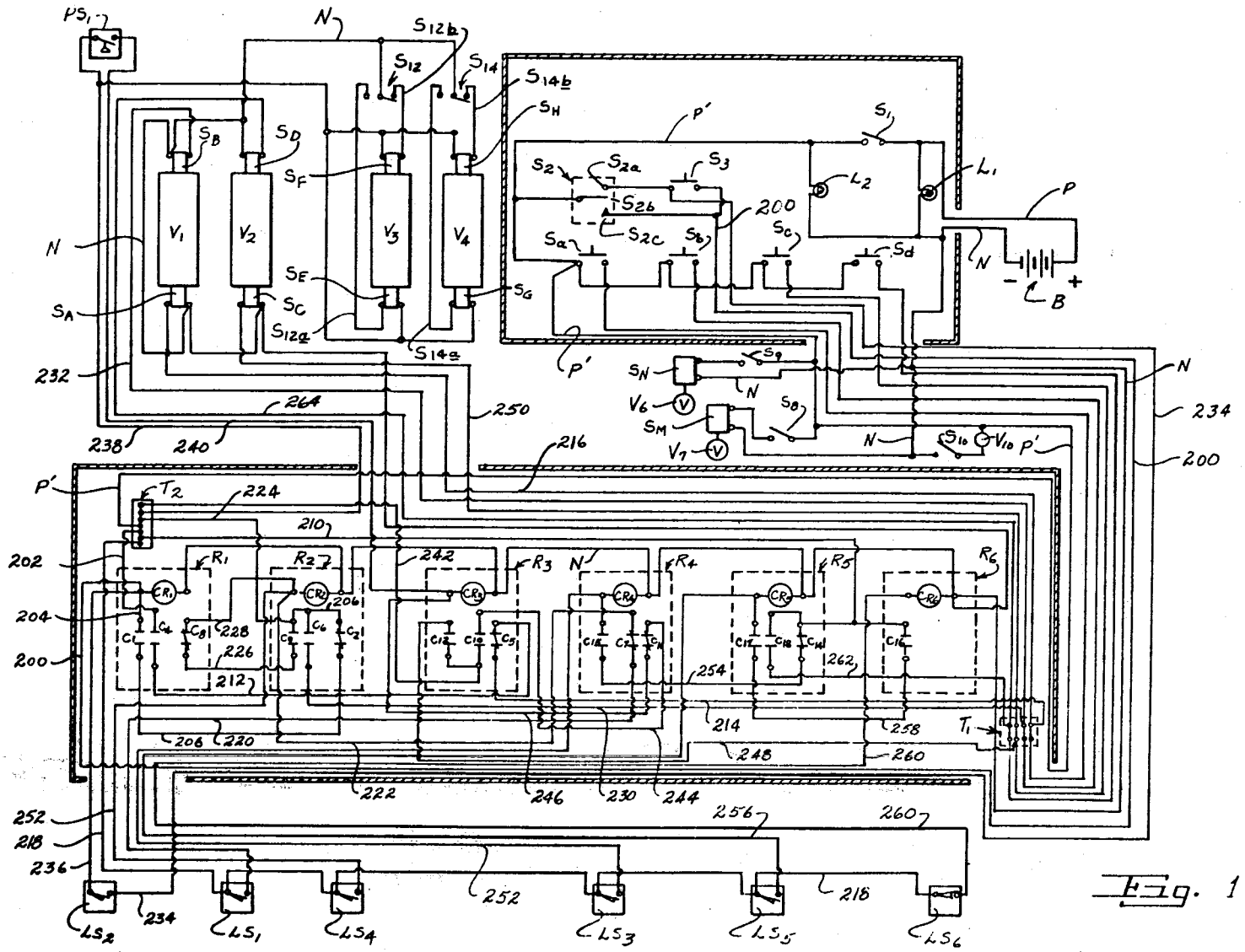
FIG. 14 is a wiring diagram of the control circuit.

The control system for the bale forming apparatus is diagrammatically illustrated in FIGS. 13 and 14 of the drawing.

As best illustrated in FIG. 13 power unit 45 is drivingly connected to pumps 140 and 142 each of which has a suction side connected to lines for drawing oil from reservoir 50.

The pressure side of pump 140 is connected through line 143 to a four-way, three-position, spring-centered, solenoid actuated valve V1.

The pressure side of the pump 142 is connected through line 144 to a multiple, three-position, solenoid controlled valving system 145 having integral check and relief valves. It should be appreciated that valve system 145 as illustrated functions to control lift motor 25, ejection cylinder 26 and dump cylinder 32 when bale forming apparatus is mounted on the vehicle hereinbefore described and illustrated in FIGS. 1–6 of the drawing. If bale forming apparatus 20 were mounted on the vehicle illustrated in FIG. 7 of the drawing, lift motor 25, ejection cylinder 26 and dump cylinder 32 would not be employed. Therefore, the specific valves employed for controlling the structure eliminated would obviously be dispensed with.

Valve system 145 comprises three solenoid actuated, four-position valves V2, V3, and V4.

Valve V1 is mounted to control flow of fluid to gate cylinders 96 for extending and retracting piston rods mounted therein.

Valve V3 is mounted for controlling fluid through lift motor 25 for moving platform 24*a* vertically through elevator apparatus 24.

The rod 27*a* of ejection cylinder 27 is extended and retracted by actuation of valve V4.

Pressure line 144 deliverying fluid through valves V2, V3, and V4 is delivered to valve V5 connected for control of dump cylinder 32.

Power unit 45 when employed as a prime mover for the vehicle is mounted in driving relation with pump 41 which delivers pressurized fluid from reservoir 50 to hydrostatic motor 40 in conventional manner.

Outlet ports of valve V1 are connected through lines 150 and 152 to opposite ends of primary compression cylinder 115 and secondary compression cylinders 116 and 118.

Line 150 is connected through a suitable coupling with line 153 connected to line 154 communicating with the inside of primary compression cylinder 115 and is connected through line 155 and pilot operated check valve 156 to reservoir 50.

Line 150 is also connected through line 157 to a normally closed pressure relief valve 158 having a discharge passage communicating through line 159 with cylinders 116 and 118. Line 159 is connected through lines 160 and 162 with pilot operated check valves 161 and 162, respectively.

Pilot line 164 connected to pilot operated check valves 156, 161 and 163 is connected to line 152 such that check valves 156, 161, and 163 will be opened when pressure in line 152 exceeds a predetermined value.

Line 152 is connected through lines 165, 166 and 167 to primary compression cylinder 115 and secondary compression cylinders 116 and 118.

Line 144, connected to the pressure side of the pump 142, is connected through line 170, pilot operated pressure relief valve 172 and pilot actuated check valve 174 to line 143. Pilot lines of valves 172 and 174 are connected to line 143 such that flow of fluid from line 144 is directed to line 143 when pressure in line 143 exceeds a predetermined value.

From the foregoing it should be readily apparent that power from power unit 45 drives pumps 140 and 142 for deliverying pressurized fluid to valve V1. When valve V1 is shifted to the right as viewed in FIG. 13 pressurized fluid from line 143 is delivered through line 150, line 153 and line 154 to primary cylinder 115 thereby moving the piston therein to the right as viewed in FIG. 13. Pilot actuated pressure relief 158 blocks the flow of pressurized fluid to cylinders 116 and 118. However, since piston rods of cylinders 115, 116, and 118 are secured to pressure head 102 pistons in cylinders 116 and 118 will move simultaneously with movement of the piston in cylinder 115, thereby drawing fluid from reservoir 50 through check valves 161 and 163 into the cylinders and discharging fluid from opposite ends thereof through line 152 to reservoir 50. Therefore secondary cylinders 116 and 118 merely pump fluid to and from reservoir 50 providing circulation of fluid in the reservoir to facilitate cooling same.

When valve V1 is shifted to the right as viewed in FIG. 13 of the drawing and pressure in line 150 exceeds a predetermined value, for example 2200 pounds per square inch, pilot actuated pressure relief valve 158 will be opened thereby deliverying fluid through line 159 to secondary compression cylinders 116 and 118. When valve 158 is opened and pressurized fluid is delivered to both primary cylinder 115 and secondary cylinders 116 and 118 the compactive force exerted by head 102 is substantially increased. However, when pressurized fluid is directed to both the primary and the secondary compression cylinders the speed of movement of head 102 is reduced proportionately.

When valve V1 is shifted to the left as viewed in FIG. 13 of the drawing pressurized fluid is delivered through line 152 and line 165 to primary cylinder 115 while line 150 is vented to reservoir thereby causing pistons in cylinders 115, 116, and 118 to be moved to the left as viewed in FIG. 13.

The wiring diagram illustrated in FIG. 14 for controlling valves of the hydraulic system is believed to be self-explanatory and will be described in conjunction with the sequence of operation hereinafter following.

Referring to FIG. 11 of the drawing an actuating lever 108' is secured to shield plate 108 which is secured to plunger head 102.

A first limit switch LS1 is secured to the frame of bale forming apparatus 20 and is positioned to be engaged by actuating member 108' as plunger head 102 reaches a predetermined position 102' as illustrated in FIG. 6 of the drawing. Limit switch LS2 is secured to the frame of bale forming apparatus 20 and is positioned to be engaged by an actuating lever 108' when plunger head 102 is positioned as illustrated in FIG. 11.

Limit switch LS4 is secured to the frame of the bale forming apparatus and is positioned to be engaged by actuating lever 108' when plunger head 102 is moved to the fully extended position for ejecting a bale from the compaction chamber. A limit switch LS5 is secured to the frame of the bale forming apparatus between limit switches LS1 and LS4 and is engaged by actuating lever 108' as plunger head 102 is retracted from a fully extended position toward the position illustrated in FIG. 11.

Gate 22 of bale forming apparatus 20 has an actuating arm 22' secured thereto for engaging limit switches LS3 and LS6 secured to gate guide frame 88 as the gate 22 is moved between elevated and lowered positions.

Referring to FIG. 14 of the drawing, the electrical control circuit generally comprises a plurality of normally open directly actuated limit switches LS1–LS5 and a normally closed directly actuated limit switch LS6 positioned on the frame of bale forming apparatus 20 as hereinbefore described and illustrated in FIG. 11 of the drawing. Limit switches LS1–LS6 are electrically connected to energize and de-energize coils of current responsive switching devices such as relays R1–R6.

Contacts of relays R1–R6 are connected to solenoids SA–SD of control valves V1–V2 to permit automatic cycling of the bale forming apparatus.

The electrical control circuit is connected to a suitable source of electricity, for example a battery B having terminals of opposite polarity.

It should be appreciated that battery B is illustrated as a simplified source of electricity. Under normal operating conditions an alternator would be driven by power unit 45 if the bale forming apparatus were mounted on a vehicle. However, if forming apparatus 20 is employed as a stationary unit, for example in a warehouse, the electrical circuit would preferably be connected to a suitable source of alternating electrical current, generally incorporating transformers if it is deemed expedient to do so depending upon specific operating conditions.

In the illustrated embodiment, the negative terminal of battery B is connected through lines N to a main power switch S1, coils CR1, CR2, CR3, CR4, CR5 and CR6 of relays R1–R6, respectively, to coils SA, SB, SC, and SD of valves V1 and V2, to switches S4 and S5 and to solenoids SM and SN which control conveyor motor (not shown) and shredder drive motor 138.

The positive terminal of battery B is connected through conductor P to single-pole, single-throw main power switch S1. Switch S1 is connected through conductor P' to the pole of selector switch S2, contacts of switches S*a*, S*b*, S*c*, S*d*, switch S8 and to terminal block T2.

Selector switch S2 comprises a three position, single-pole switch having three terminals. When the pole switch S2 engages contact S2*a* the circuitry is arranged to maintain automatic cycling of the bale forming apparatus after start switch S3 has been momentarily closed. When the pole of switch S2 is in engagement with terminal S2*b* the switch S2 is in the off position. When the pole of switch S2 is momentarily moved into engagement with terminal S2*c* one cycle of operation will be initiated.

AUTOMATIC OPERATION

Indicator light L1, which is connected between lines N and P, will be illuminated indicating that power is on.

Closing main power switch S1 results in illumination of indicator light L2, which is connected beween line P' and line N.

Movement of the pole of selector switch S2 into engagement with contact S2*a* establishes an automatic sequence of operation. When the pole of selector switch S2 is in the automatic position, the cycle start switch S3 must be closed momentarily to initiate an operating cycle of the bale forming apparatus.

Automatic cycling will allow plunger head 102 to continuously extend and retract, making a finished bale, ejecting the bale and continuing to cycle automatically.

Closing cycle start switch S3 completes a circuit through line 200 to energize the coil CR1 of relay R1.

Normally open contact C4 of relay R1 is connected through conductor 202 to the power supply line P' through terminal connector T2. Contact C1 of relay R1 is connected through line 204 to the coil CR1. Energization of the coil CR1 of relay R1, upon momentarily closing switch S3, closes normally open switches C1 and C4. Closing of switch C1 forms a holding circuit through line 206, and line 224 which is connected through terminal board T2 to power line P'.

The closing of switch C4 of relay R1 completes a circuit through line 212, normally closed switch C5 of relay R3, line 214, terminal board T1, and line 216 to energize solenoid SA thereby shifting valve V1 to the right as viewed in FIG. 13 directing pressurized fluid through line 150 and line 154 for extending the rod of cylinder 115 moving plunger head 102 through the compaction chamber to compress material for forming a bale.

Movement of plunger head 102 moves actuating lever 108' carried by shield plate 108 into engagement with limit switch LS1.

Limit switch LS1, as illustrated in FIG. 14, is connected through line 218 and terminal board T2 to power line P'. It should be noted that switches LS3, LS4, LS5, and LS6 are also connected through conductor 218 to power line P'.

The opposite side of limit switch LS1 is connected through conductor 220, normally closed switch C7 of relay R4, and conductor 222 to the coil CR2 of relay R2. Thus, when actuating lever 108' momentarily closes limit switch LS1, the coil CR2 of relay R2 is momentarily energized thereby opening the normally closed switch C2 of relay R2 breaking the holding circuit through line 206 to the coil CR1 of relay R1. The normally open switches C6 and C9 of relay R2 are connected through conductor 224 to power line P' through terminal connector T2. Closing the switch C9 completes a holding circuit through conductor 226, normally closed switch C8 of relay R1 and conductor 228 to the coil CR2 of relay R2. Closing of switch C6 delivers power through conductor 230, terminal board T1, and conductor 232 to solenoid SB thereby shifting valve V1 from the neutral position to left as viewed in FIG. 13 thereby deliverying pressurized fluid through line 152 to the rod end of cylinder 115 thereby retracting the rod and plunger head 102.

As plunger head 102 is retracted, actuating arm 108' will momentarily close limit switch LS2. One side of limit switch LS2 is connected through conductor 234 to contact S2*a* of selector switch S2, while the opposite side of limit switch is connected through conductor 236 to the coil CR1 of relay R1.

From the foregoing it should be readily apparent that movement of actuating lever 108' between limit switches LS1 and LS2 will result in sequential energization of solenoids SA and SB thereby extending and retracting plunger head 102 until sufficient material is accumulated in the compaction chamber to prevent movement of plunger head 102 a distance sufficient to permit closing of limit switch LS1 by actuating arm 108'.

Upon referring to FIG. 13 of the drawing it will be appreciated that pressurized fluid is delivered from the first pump 140 to valve V1 through line 143 until pressure in line 143 exceeds a predetermined pressure level at which time pilot actuated valves 172 and 174 will be opened permitting flow of fluid through line 144 and line 170 from pump 142 into line 143 thereby automatically increasing the volume of pressurized fluid delivered to line 143 at a pre-established pressure level.

When pressure of fluid delivered from valve V1 through line 150 exceeds a predetermined pressure level, pressure relief valve 158 will be actuated thereby deliverying pressurized fluid through line 159 to secondary compression cylinders 116 and 118. Thereby increasing the area acted upon by the pressurized fluid. For example, if the pistons in the primary compression cylinder 115 and in the secondary compression cylinders 116 and 118 are equal, the force exerted for moving plunger head 102 will be three times the force exerted through primary compression cylinder 115 prior to the opening of pressure relief valve 158. However, flow of pressurized fluid from positive displacement pumps 140 and 142, after valves 172 and 174 have opened, is substantially constant. Therefore, movement of plunger head 102 upon opening of valve 158 will be at a reduced speed.

When force applied by the bale resisting movement of plunger head 102 exceeds a predetermined magnitude, the pressure switch PS1 communicating with line 143 will be closed.

As best illustrated in FIG. 14 pressure switch PS1 is adapted to close upon increase of fluid pressure to a predetermined pressure level. One side of switch PS1 is connected through conductor 238 and terminal board T2 to power line P'. The other side of pressure switch PS1 is connected through conductor 240 to the coil CR3 of relay R3. While fluid is being directed to both the primary and secondary compression cylinders 115–118, plunger head 102 will continue to cycle in the manner hereinbefore described so long as actuating arm 108' is moved into engagement with limit switch LS1 at the forward limit of the stroke. However, when pressure in line 143 closes pressure switch PS1, thereby energizing coil CR3 of relay R3, the normally closed switch C5 of relay R3 is opened thereby breaking the circuit through line 214 and 216 to solenoid SA causing V1 to shift to the neutral position. However, the holding circuit to the coil CR1 of relay R1 through normally closed contacts C2 of relay R2 is not broken; and, therefore, the coil CR1 of relay R1 remains energized.

Switches C10 and C12 of relay R3 are connected through conductor 242 and terminal board T2 to power line P'. Closing of switch C10 of relay R3 completes a holding circuit through line 244, contact C11 of relay R4 and line 246 to the coil CR3 of relay R3.

Closing of switch C12 of relay R3 completes a circuit through conductor 248, terminal board T1, and conductor 250 to energize solenoid SC thereby shifting valve V2 downwardly as viewed in FIG. 13, directing pressurized fluid from pump 142, through line 144 and line 97' to cylinders 96 and 97 for raising gate 22.

Upward movement of gate 22 moves actuating arm 22' into engagement with limit switch LS3 thereby completing a circuit through conductor 252 to energize the coil CR4 of relay R4. When the coil CR4 of relay R4 is energized normally closed switches C7 and C11 will be opened breaking the holding circuit to the coil CR3 of relay R3 through conductor 246. De-energization of coil CR3 of relay R3 breaks the circuit through switch C12 of relay R3, line 248 and line 250 to solenoid SC thereby permitting shifting of valve V2 to the neutral position stopping flow of pressurized fluid to gate lift cylinders 96 and 97. Closing of normally closed switch C5 of relay R3 re-establishes a circuit through conductor 214 and conductor 216 to energize solenoid SA thereby shifting valve V1 to the right as viewed in FIG. 13 causing head 102 to fully extend ejecting the completed bale from the bale forming apparatus. As head 102 is fully extended, actuating lever 108' closes limit switch LS4 thereby completing a circuit through conductor 252 to energize the coil CR2 of relay R2. As hereinbefore explained, a holding circuit for coil CR2 is completed through normally open contact C9, conductor 226, normally closed switch C8 of relay R1 and conductor 228. Closing of switch C6 of relay R2 energizes solenoid SB through conductor 230 and conductor 232 for shifting valve V1 to the right as viewed in FIG. 13 thereby retracting plunger head 102. When normally closed switch C2 of relay R2 is opened upon energization of coil CR2, the holding through conductor 206 and contact C1 of relay R1 is broken thereby de-energized relay R1.

As plunger head 102 retracts from the fully extended position, limit switch LS5 is engaged by actuating arm 108' completing a circuit through conductor 256 to energize the coil CR5 of relay R5. Opening of normally closed switch C4 breaks the holding circuit through conductor 254 to the coil CR4 of relay R4. When the coil CR4 of relay R4 is de-energized limit switch LS1 and relay R3 are reset for the next operating cycle.

Closing of normally open switch C17 of relay R4 completes a holding circuit through normally open switch C16 of relay R6 through conductor 258. It should be appreciated that upward movement of gate 22 permitted closing of the normally closed limit switch LS6 thereby energizing the coil CR6 of relay R6 through conductor 260. Closing of switch C18 of relay 85 completes a circuit through conductor 262, terminal board T1, and conductor 264 to solenoid SD thereby shifting valve V2 upwardly as viewed in FIG. 13 directing pressurized fluid from line 144 through line 96' to upper ends of gate lift cylinders 96 and 97 thereby lowering gate 22.

When actuating arm 22' on gate 22 engages normally closed limit switch LS6, the circuit through conductor 260, energizing the coil CR6 of relay R6, is broken. Opening of normally open switch C16 of relay R6 breaks the holding circuit through conductor 258 to coil CR5 of relay R5.

Rearward movement of actuating lever 108' into engagement with limit switch LS2, energizes the coil CR1 of relay R1 thereby initiating another complete cycle of operation.

Each of the solenoids SA, SB, SC, and SD can be manually energized by momentarily closing switches *Sa*, *Sb*, *Sc*, and *Sd* connected to terminal board T1 through conductors 216', 232', 250', and 264', respectively, for jogging the machine when selector switch S2 is in the off position.

To terminate automatic cycling of the baling apparatus, selector switch S2 is moved to the off position permitting plunger head 102 to stop in the fully retracted position.

SEMI-AUTOMATIC OPERATION

When the pole of selector switch S2 is in engagement with contact S2C of switch S2 the circuit is connected for semi-automatic operation.

Momentary engagement of the pole of switch S2 with contact S2C completes a circuit through conductor 200 thereby energizing the coil CR1 of relay R1. Energization of coil CR1 of relay R1 establishes a holding circuit through contact C1 and energizes solenoid SA of valve V1 upon closing of contacts C4 in the manner hereinbefore described in connection with automatic operation. Energizing solenoid SA causes routing of pressurized fluid to extend plunger head 102 until limit switch LS1 is closed.

Closing of limit switch LS1 energizes the coil CR2 of relay R2 thereby energizing solenoid SB shifting valve V1 for directing pressurized fluid for retracting plunger head 102 and de-energizing coil CR1 of relay R1. Plunger head 102 will move to the fully retracted position and stop. If when plunger head 102 is extended and the cycle selector switch S2 is in the semi-automatic position and the material being compressed is ready for ejection, the machine will automatically eject the bale and the head will return to retracted position and stop as hereinbefore described in connection with the automatic cycle of operation.

From the foregoing it should be readily apparent that the apparatus hereinbefore described accomplishes the objects of the invention hereinbefore discussed.

Conveyor motor 132 (FIG. 12) is preferably hydraulically driven through a solenoid actuated valve V6 and is manually actuated by closing switch S9.

Shredder drive motor 138 is actuated by manually closing switch S8 to open valve V7.

The valve V10 in spray line 129 is opened by closing switch S10.

Switches S12 and S14 are manually actuated to energize solenoids SE and SF and solenoids SG and SH to shift valve V3 and V4 to control lift motor 25 of elevator apparatus 24 and ejector cylinder 27.

Valve V5 is manually shifted for dumping bales B.

Having described my invention, I claim:

1. Bale forming apparatus comprising: support means; a compaction chamber having an inlet passage and an outlet passage; means to secure said chamber to said support means; closure means adjacent said outlet passage; means to move said closure means between a first position across said outlet passage and a second position spaced from said outlet passage; a ram movable through said chamber between said inlet passage and said outlet passage; a plurality of cylinders, each of said cylinders having a piston movable therethrough and a rod secured to the piston, said rod extending through an end of each cylinder; a common head securing each of said cylinders to said support means; means securing each of said rods to said ram; means to selectively direct pressurized incompressible fluid to opposite ends of a first of said plurality of cylinders to move said ram toward said outlet or toward said inlet; means to direct pressurized fluid to a second to said plurality of cylinders to move said ram toward said outlet when force exceeding a predetermined magnitude restrains movement of said ram toward said outlet passage by said first cylinder; a source of incompressible liquid; and means connecting said source of incompressible liquid to opposite ends of said second plurality of cylinders such that said second plurality of cylinders remain full of incompressible liquid as said pistons move through each of said cylinders.

2. The combination called for in claim 1 with the addition of: shield means on said ram arranged to close said inlet passage upon movement of said ram toward said outlet passage.

3. The combination called for in claim 1 with the addition of: shear means on said ram and on said chamber adjacent said inlet passage, said shear means being arranged to sever material extending through said inlet passage into said chamber.

4. The combination called for in claim 1 with the addition of: means to inject bonding substance into said chamber such that heat and pressure of compactive force exerted by said ram will bond particles of the compacted material.

5. The combination called for in claim 1 with the addition of: a face on said closure means against which material is compacted; and means to mount said closure means such that the face is not perpendicular to the longitudinal axis of the chamber.

6. The combination called for in claim 1 with the addition of: a storage container; elevator means adjacent said closure means, said elevator means being adapted to receive a bale discharged through said outlet passage; and means to move said elevator means for lifting a bale toward said storage container.

7. The combination called for in claim 6 with the addition of: ejector means mounted adjacent said elevator means; and means to actuate said ejector means for moving a bale from said elevator means into said storage container.

8. The combination called for in claim 1 wherein: the support means comprises a vehicle.

9. The combination called for in claim 1 with the addition of means preventing delivery of pressurized fluid to said second of said plurality of cylinders when pressurized fluid is directed to said first of a plurality of cylinders to move said ram toward said inlet.

10. The combination called for in claim 1 wherein said support means comprises a vehicle frame; a storage container on said vehicle frame; and means on said vehicle frame to transfer bales formed in said bale forming apparatus into said storage container.

11. Apparatus to compress refuge compring: support means; a chamber; means securing said chamber to said support means; a ram movable through said chamber; a first pressure actuated cylinder; a first rod movable relative to said first cylinder; means securing said first rod to said ram; a second pressure actuated cylinder; a second rod movable relative to said second cylinder; means securing said second rod to said ram; means securing said first and second cylinders to said support means; a source of pressurized imcompressible liquid; means to connect said source of pressurized imcompressible liquid to said first pressure actuated cylinder; valve means between said source of pressurized imcompressible liquid and said second pressure actuated cylinder; means to actuate said valve means when pressure of liquid delivered to said first pressure actuated cylinder exceeds a predetermined pressure such that pressurized liquid is directed to the first and second pressure actuated cylinders for moving said ram through said chamber; a source of incompressible liquid at substantially atmospheric pressure; and means connecting said source of incompressible liquid to opposite ends of said second pressure actuated cylinder such that said second pressure actuated cylinder remains full of incompressible liquid as said second rod moves relative to said second cylinder.

12. The combination called for in claim 11 wherein: said chamber has an outlet passage; closure means across said outlet passage; a third pressure actuated cylinder secured to said closure; and pressure sensing means connected to said source of pressurized fluid arranged to deliver fluid to said third cylinder when pressure of fluid delivered to the first and second cylinders exceeds a predetermined pressure.

13. The combination called for in claim 12 with the addition of: means for applying glue to paper in said chamber to form a papier-mache bale of waste paper.

14. In a bale forming apparatus where a ram is to be moved by a pressure actuated means through a compaction chamber to compress material, the pressure actuated means comprising: first, second and third fluid actuated cylinders, each of said cylinders having a piston and a rod slideably disposed therein; means to secure of each of said cylinders to the ram such that the rod of the first cylinder is secured to the ram intermediate points to which the rods of the second and third cylinders are secured to the ram such that delivery of pressurized fluid to either of said first or second or third fluid actuated cylinders will result in application of force to said ram and such that rods of each of said cylinders will move simultaneously when pressurized fluid is delivered to said first cylinder; a common head secured to each of said cylinders; means securing said common head relative to the compaction chamber; means to selectively deliver imcompressible pressurized fluid to opposite ends of said first fluid actuated cylinder; and means to deliver incompressible pressurized fluid to said first, second and third fluid actuated cylinders to increase force to move said ram when force exceeding a predetermined magnitude resists movement of said ram through said chamber.

* * * * *